US006905392B2

(12) United States Patent
Bottema et al.

(10) Patent No.: US 6,905,392 B2
(45) Date of Patent: Jun. 14, 2005

(54) POLISHING SYSTEM HAVING A CARRIER HEAD WITH SUBSTRATE PRESENCE SENSING

(75) Inventors: Brian E. Bottema, Austin, TX (US); Keven A. Cline, Austin, TX (US); Morris S. Poteet, Dripping Springs, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/609,996

(22) Filed: Jun. 30, 2003

(65) Prior Publication Data

US 2004/0266324 A1 Dec. 30, 2004

(51) Int. Cl.[7] ..... B24B 49/00; B24B 47/02

(52) U.S. Cl. ..... 451/5; 451/9; 451/288; 451/389; 451/289

(58) Field of Search ..... 451/5, 8, 9, 285–290, 451/388, 397, 385, 398; 279/3; 294/64.1, 907; 414/941, 627, 752; 269/21

(56) References Cited

U.S. PATENT DOCUMENTS 5,957,751 A 9/1999 Govzman et al.
5,961,169 A * 10/1999 Kalenian et al. ..... 294/64.1
6,227,955 B1 5/2001 Custer et al.
6,244,942 B1 6/2001 Zuniga
6,663,466 B2 * 12/2003 Chen et al. ..... 451/8
6,705,924 B2 * 3/2004 Somekh ..... 451/9
6,755,726 B2 * 6/2004 Chen et al. ..... 451/398
2002/0002025 A1 1/2002 Chen et al.

FOREIGN PATENT DOCUMENTS

EP 1 101 567 A1 5/2001

* cited by examiner

*Primary Examiner*—Hadi Shakeri
(74) *Attorney, Agent, or Firm*—Michael J. Balconi-Lamica

(57) ABSTRACT

A system for polishing a substrate has a controller, pressure source, a platen, and a carrier for handling the substrate. The carrier must be able to detect if a substrate is present. In either the case of a false detection of substrate presence or the failure to detect substrate presence, the likely result is damaged substrates, wasted polishing consumables, and down time of the manufacturing facility. Detection is achieved by the substrate causing movement of a plunger and by such movement resulting in a pressure differential that is detected. The reliability of this detection is improved by one or more of a precise relationship of the plunger to a plate that applies pressure to the substrate, a controlled seal that is ensured of being broken when the plunger is moved by the presence of a substrate, and proper spring pressure applied to the plunger to prevent spurious plunger movement.

21 Claims, 3 Drawing Sheets

-PRIOR ART-

-PRIOR ART-

POLISHING SYSTEM HAVING A CARRIER HEAD WITH SUBSTRATE PRESENCE SENSING

BACKGROUND

1. Field of the Invention

The invention relates generally to the field of semiconductor manufacturing, and more specifically to a polishing system having a carrier head with substrate presence sensing.

2. Related Art

A wafer carrier is a critical component of a polisher. The wafer carrier serves two main purposes. A first purpose is to transport a wafer to/from a load station and between each polishing process area. A second purpose is to press the wafer downward against a polishing pad using a backside pressure while the polish pad and the wafer carrier rotate at high speeds. The type of carrier determines how pressure is applied to the backside of the wafer. One type of carrier includes an internal wafer presence sensor to verify that a wafer is loaded onto the carrier.

FIG. 1 is a cross sectional view of a carrier head having a substrate sensing mechanism according to the prior art. Carrier head 10 includes a perforated plate 12, and a gimbal plate 14 disposed within retaining ring 16. An edge control ring 20 holds a membrane 22 across a bottom surface of perforated plate 12. The substrate sensing mechanism of carrier head 10 includes a plunger 24 disposed within a sensor venting port 50 of gimbal plate 14. Plunger 24 is resiliently held within the venting port by a weak spring 26 disposed between a top portion of plunger 24 and an encapsulated region defined by reference numeral 28. An oversized non-captured O-ring 30 is disposed between a flange portion of the plunger 24 and a top surface of gimbal plate 14, around the venting port 50. Pressure sensor 32 monitors a pressure within encapsulated region 28. Under normal operating conditions, encapsulated region 28 is either pressurized or vented.

Plunger 24 can move vertically within sensor venting port 50 between a lower most travel position and an upper most travel position. The lower most travel position is defined by a combination of the plunger flange, the oversized non-captured O-ring 30, and the top surface of the gimbal plate 14. When in the lower most travel position, a bottom portion of plunger 24 extends below a lower most surface of perforated plate 12 by a distance indicated by reference numeral 36. The upper most travel position is defined by a top surface of the plunger flange and a surface above the flange within encapsulated region 28. When in the upper most travel position, a top portion of the plunger 24 is moved a distance as indicated by reference numeral 34.

FIG. 2 is a top view of a substrate sensor venting port and an oversized non-captured O-ring according to the prior art. For example, a portion of gimbal plate 14 containing the substrate sensor venting port 50 is shown. The diameter of venting port 50 is slightly larger than a diameter of the plunger 24 to allow the plunger 24 to move within port 50. To provide for venting, venting arteries or channels 52 are disposed along an inner sidewall of port 50, extending from a top surface of gimbal plate 14 to a bottom surface of gimbal plate 14. The use of the oversized non-captured O-ring 30 increases a possibility for impeding the venting of the encapsulated region, resulting in an erroneous sensing performance. That is, O-ring 30 is subject to various placements about the venting port 50, for example, off-center from the venting port 50. It is also possible for the placement of O-ring 30 to preclude passage of vacuum or pressure through one or more arteries 52.

Carrier head 10 suffers from reliability issues of the wafer sensing mechanism. Such reliability issues lead to various handling problems that include one or more of dechuck errors, false wafer loss alarms, and failure to detect wafer loss. A dechuck error generally refers to a situation wherein a wafer slips off the carrier onto the underlying polishing pad as the carrier attempts to lift off the polishing pad after processing, typically resulting in breakage of the wafer. A false wafer loss alarm generally refers to a situation wherein the carrier incorrectly senses no wafer presence although a wafer is physically loaded, typically resulting in various handling errors. A failure to detect wafer loss generally refers to a situation wherein the carrier incorrectly senses a wafer when a wafer is not physically present, typically resulting in wafer breakage of a wafer that gets left behind. Such problems cause product scrap, tool downtime/reduced availability, and increased wafer polishing and carrier consumable cost.

Accordingly, it would be desirable to provide a carrier head with improved wafer sensing to overcome the problems in the art.

SUMMARY

According to one embodiment, a system for polishing a substrate includes a controller, a platen, and a carrier head. The carrier head is coupled to the controller. The carrier head is for carrying the substrate and holding the substrate against the platen during polishing. The carrier head includes a retaining ring for laterally supporting the substrate, a holding mechanism for applying positive pressure to the substrate during polishing and negative pressure when carrying the substrate, a gimbal plate coupled to the holding mechanism, and substrate detection means, coupled to the gimbal plate for detecting if the substrate is secured by the holding mechanism when the holding mechanism is applying negative pressure. The substrate detection means includes a plunger passing through a hole in the gimbal plate. The plunger has a maximum travel distance in the hole, has a bottom surface that extends below the gimbal plate and is coupled to the substrate during detecting. When the holding mechanism is pressed to the gimbal plate, the plunger extends past the holding mechanism by an amount substantially equal to the maximum travel distance of the plunger.

BRIEF DESCRIPTION OF THE DRAWINGS

The embodiments of the present disclosure are illustrated by way of example and not limited by the accompanying figures, in which like references indicate similar elements, and in which.

DETAILED DESCRIPTION

Figure 3:
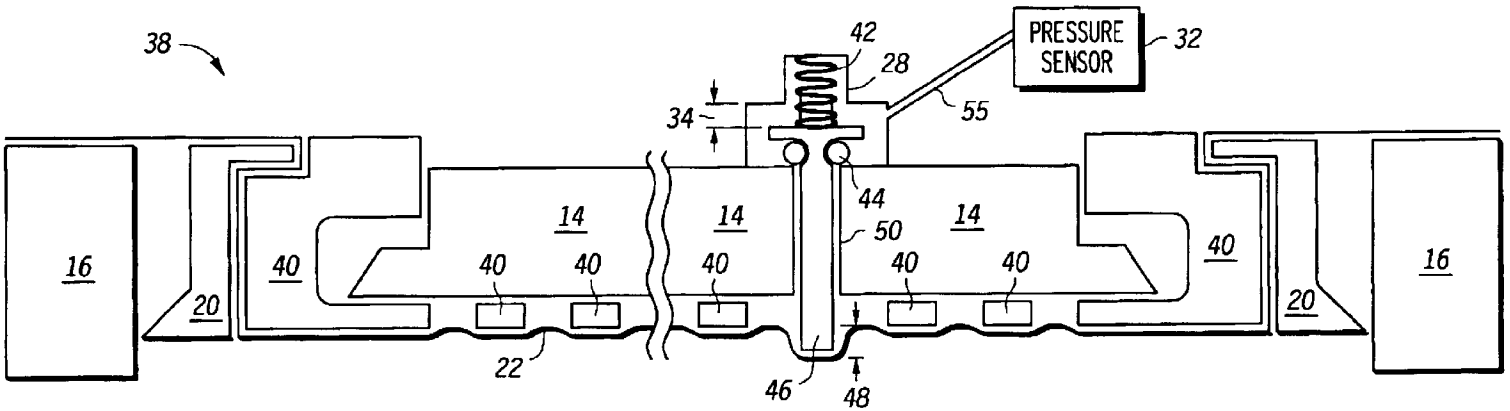
FIG. 3 is a cross sectional view of a carrier head with a substrate presence sensing mechanism according to an embodiment of the present disclosure.

FIG. 3 is a cross sectional view of a carrier head with a substrate presence sensing mechanism according to an embodiment of the present disclosure. Carrier head 38 includes a perforated plate 40, and a gimbal plate 14 disposed within retaining ring 16. An edge control ring 20 holds a membrane 22 across a bottom surface of perforated plate 40. In one embodiment, the perforated plate 40 has a thickness on the order of 0.100+/−0.005 in. Such a thickness enables an optimal wafer sense plunger extension, allowing the wafer sensor to vent the membrane 22 when a wafer is physically present.

The substrate sensing mechanism of carrier head 38 includes a plunger 46 disposed within a sensor venting port 50 of gimbal plate 14. Plunger 46 is resiliently held within the venting port by spring 42 disposed between a top portion of plunger 46 and an encapsulated region defined by reference numeral 28.

A captured resilient sealing ring 44 is disposed between a flange portion of the plunger 46 and a top surface of gimbal plate 14, around the venting port 50. Sealing ring 44 includes any suitable resilient material capable of withstanding polishing process conditions, as appropriate. Pressure sensor 32 monitors a pressure within encapsulated region 28. Under normal operating conditions, encapsulated region 28 is either pressurized or vented.

Spring 42 is a spring of sufficient strength for sealing with the captured resilient sealing ring 44, the chamber defined by the encapsulated region 28, and the region between the bottom portion of the gimbal plate 14 and the membrane 22. Spring 42 is selected to also provide a sufficient force such that in response to pulling a vacuum on the membrane 22, in the absence of a substrate, the membrane 22 does not overcome the force provided by spring 42, and accordingly, does not breach the seal provided by the sealing ring 44 and the top of plate 14. Still further, spring 42 must allow the sensor to be depressed in the event of pulling vacuum on a substrate, wherein the substrate acts upon the plunger 46, breaking the seal otherwise provided by the sealing ring 44 and the top of plate 14. Spring 42 must also not prevent a bottom portion of plunger 46 from aligning flush with a bottom side of perforated plate 40. In one embodiment, spring 42 has a stiffness rating on the order of 19+/−5 lb/in, which allows wafer sensor actuation even under the highest possible membrane vacuum setting, while reliably actuating during physical wafer presence.

Figure 1:
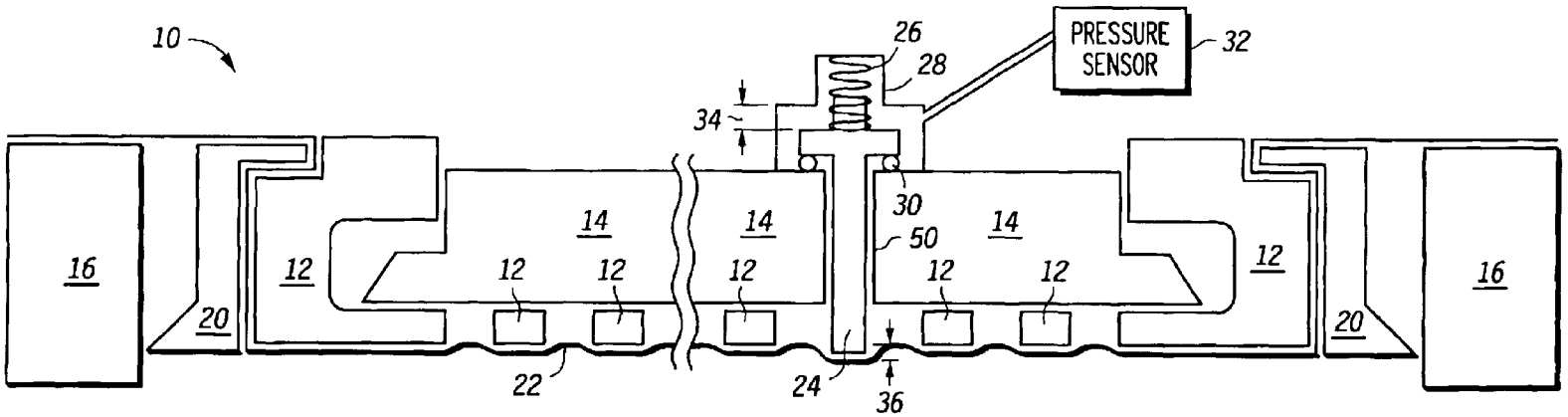
FIG. 1 is a cross sectional view of a carrier head having a substrate sensing mechanism according to the prior art.
Figure 2:
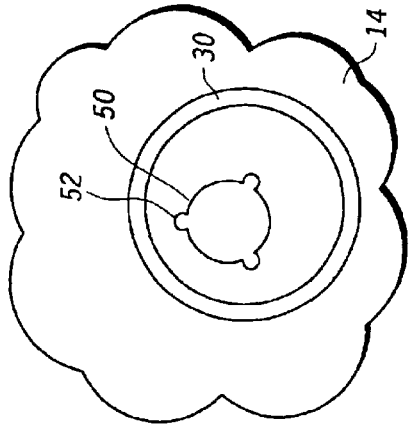
FIG. 2 is a top view of a substrate sensor venting port and an oversized non-captured O-ring according to the prior art.

Plunger 46 can move vertically within sensor venting port 50 between a lower most travel position and an upper most travel position. The lower most travel position is defined by a combination of the plunger flange, the captured resilient sealing ring 44, and the top surface of the gimbal plate 14. When in the lower most travel position, a bottom portion of plunger 46 extends below a lower most surface of perforated plate 40 by a distance indicated by reference numeral 48. Note that the distance 48 is greater than the distance 36, shown in FIG. 1. The upper most travel position is defined by a top surface of the plunger flange and a surface above the flange within encapsulated region 28. When in the upper most travel position, a top portion of the plunger 46 is moved a distance as indicated by reference numeral 34. To ensure that a bottom portion of plunger 46 does not extend below the lower surface of perforated plate 40 when the plunger is in an uppermost position, distance 48 must be less than or equal to distance 34.

Figure 4:
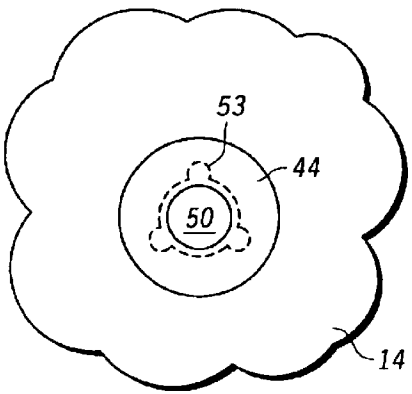
FIG. 4 is a top view of a substrate sensor venting port and a captured compliant sealing ring according to an embodiment of the present disclosure.

FIG. 4 is a top view of a substrate sensor venting port and a captured compliant sealing ring according to an embodiment of the present disclosure. For example, a portion of gimbal plate 14 containing the substrate sensor venting port 50 is shown. The diameter of venting port 50 is slightly larger than a diameter of the plunger 46 to allow the plunger 46 to move within port 50. To provide for venting, venting arteries or channels 53 are disposed along an inner sidewall of port 50, extending from a top surface of gimbal plate 14 to a bottom surface of gimbal plate 14. The use of the captured resilient sealing ring 44 increases a possibility for assuring the venting of the encapsulated region, as well as sealing of the encapsulated region, resulting in an improved sensing performance. That is, plunger 46 captures resilient sealing ring 44 in a manner which makes the captured resilient sealing ring 44 subject to repeatable placement about and on-center with the venting port 50. Accordingly, the placement of captured resilient sealing ring 44 assures both the passing and the blocking of vacuum or pressure, as needed, through arteries 53.

In one embodiment, arteries 53 are constructed to have equal or greater area than the orifice 55 between encapsulated region 28 and pressure sensor 32. For example, orifice 55 may have an orifice size within encapsulated region 28 on the order of approximately 0.050" in diameter. The size of the three arteries 53 can each be on the order of an approximately 0.025" radius half circle.

A benefit of the increased volume provided by arteries 53 can be understood from the following illustration. During a wafer dechuck or removal of a wafer from the polishing pad, the encapsulated region 28 is under positive pressure. The wafer presses against the wafer sensor. In addition, the vacuum within the membrane area must overcome the positive pressure and cause a delta-pressure on sensor 32. With the embodiments of the present disclosure, a threshold on the order of approximately 0.8 to 1.0 Vdc on sensor 32 can be obtained, in contrast to a threshold on the order of approximately 0.3 to 0.5 Vdc with known wafer sensor embodiments. As a result of increased threshold, a tool constant value on the order of approximately 0.5 Vdc can be used, in comparison to a tool constant value on the order of 0.2 Vdc of a known wafer sensor embodiments. Accordingly, the embodiments of the present disclosure provide more reliable sensing and greater confidence that a wafer is actually pressed against the sensor and removed from the pad, rather than in a transition of moving from the pad and against the sensor.

Figure 5:
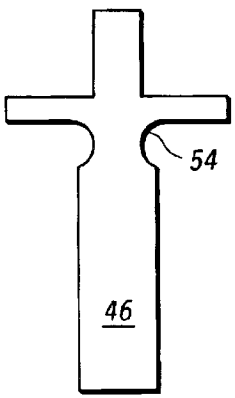
FIG. 5 is a section view of a substrate sensing plunger according to an embodiment of the present disclosure.

FIG. 5 is a section view of a substrate sensing plunger according to an embodiment of the present disclosure. More particularly, plunger 46 includes a top portion and a bottom portion, separated by a flange portion. Between the flange portion and the bottom portion, plunger 46 includes a recessed region 54. The recessed region is adapted for receiving and capturing the resilient sealing ring 44 therein. Once captured, movement of the resilient sealing ring with respect to the venting port 50 is more precisely controlled by plunger 46. Accordingly, a reliability of sensing the presence or absence of a semiconductor substrate is greatly enhanced.

Figure 6:
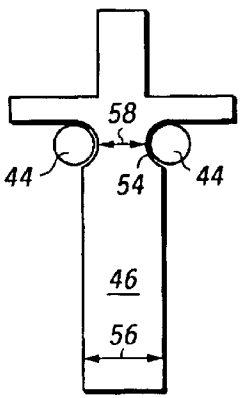
FIG. 6 is a section view of a substrate sensing plunger with a captured sealing ring according to an embodiment of the present disclosure.

FIG. 6 is a section view of a substrate sensing plunger with a captured sealing ring according to an embodiment of the present disclosure. As shown, resilient sealing ring 44 is captured within recess 54. A bottom portion of plunger 46 has a first diameter, as indicated by reference numeral 56. Recess 54 has a second diameter, as indicated by reference numeral 58. The second diameter 58 is on the order of less than the first diameter 56. In one embodiment, diameter 58 is on the order of slightly larger than an inner diameter of resilient sealing ring 44. In addition, the inner diameter of resilient sealing ring 44 is less than the diameter 56 of the bottom portion of plunger 46.

Figure 7:
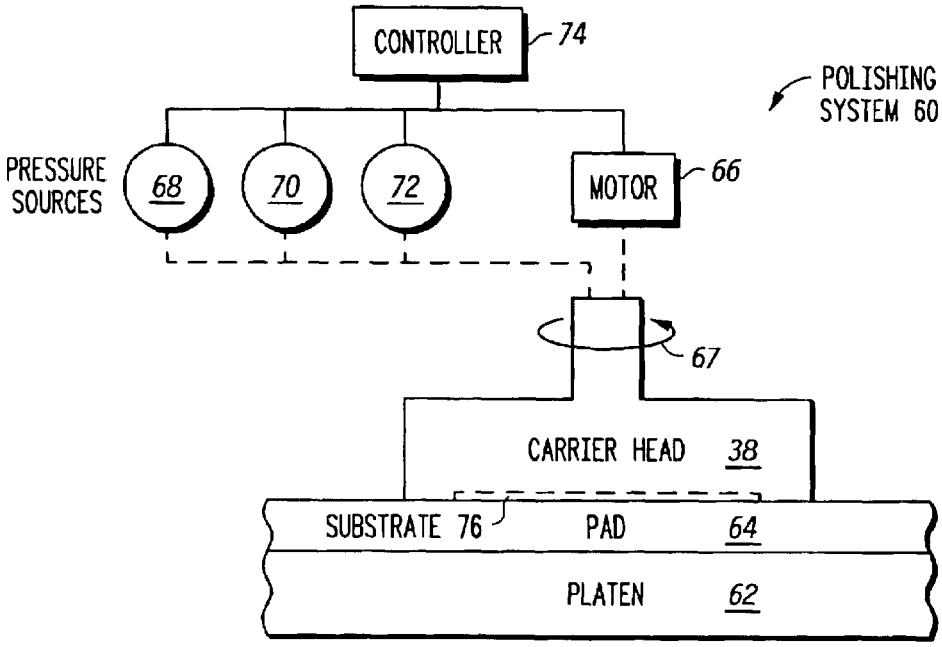
FIG. 7 is a block diagram view of a polishing system having a carrier head with substrate presence sensing according to an embodiment of the present disclosure.

FIG. 7 is a block diagram view of a polishing system having a carrier head with substrate presence sensing according to an embodiment of the present disclosure. Polishing system 60 includes a carrier head 38, a platen 62, polishing pad 64, motor 66, one or more pressure sources (68,70,72), and controller 74. Carrier head 38 includes the substrate carrier head discussed herein above with respect to FIGS. 3, 4, 5 and 6. Carrier head 38 retains a substrate 76 within the retaining ring 16 during a polishing operation.

A polishing operation generally includes a substrate attach/detach step and a substrate transport step, in addition to the substrate polishing. During a substrate transport portion of a polishing operating, the carrier head transports the substrate between a substrate loading and unloading position, as well as, transports the substrate from a non-contact polishing position (i.e., substrate not in contact with the polishing pad) to a contact polishing position (i.e., substrate in contact with the polishing pad), or vice versa. Substrate attachment and/or detachment prior to transport is accomplished with the carrier head 38, one or more pressure sources (68,70,72)and membrane 22. In particular, for carrying out attachment of a substrate to the carrier head, a vacuum is drawn behind membrane 22 and within the openings of perforated plate 40. The vacuum causes a suctioning effect between the membrane 22 and the substrate to be transported. For detachment, the vacuum behind membrane 22 is vented, thereby releasing the suctioning effect between the membrane 22 and the substrate.

Platen 62 and pad 64 can include any suitable platen/pad for a particular polishing operation. For example, in one embodiment, platen 62 and polishing pad 64 may include a single platen/pad unit. Motor 66 provides rotation of carrier head 38, as indicated by reference numeral 67. Pressure sources (68,70,72) provide either vacuum or pressure to carrier head 38, as appropriate, for use in a given portion of a polishing operation. Additional pressure sources may also be used. Controller 74 provides control of one or more portions of polishing operations via pressure sources (68, 70,72) and motor 66. In addition, controller 74 can provide additional controls as may be needed for the requirements of a particular polishing operation.

During an initial loading for a polishing operation, the carrier head 38 is positioned over a loading mechanism (not shown) for picking up a substrate, for example, as indicated by reference numeral 76. Membrane 22 is vented, i.e., pressure is relieved from the region between the lower surface of plate 14, perforated plate 40, and an upper surface of membrane 22. A dechuck bladder (not shown), such as is well known in the art, allows pressurizing of the encapsulated region 28. The pressurized region 28 is sensed by pressure sensor 32. The substrate is raised to a loading position by the loading mechanism, wherein the substrate acts upon plunger 46 in an upward fashion. Vacuum is applied to membrane 22, in a region between an underside of plate 14, the perforated plate 40, and above membrane 22. Subsequent venting of the region 28 occurs due to the upward displacement of plunger 46 by the underlying substrate, moving the captured resilient sealing ring 44 in a controlled manner to enable an assured venting of region 28. Accordingly, a change in pressure sensed by pressure sensor 32 indicates the presence of the substrate.

During a polishing operation, membrane 22 and retaining ring 16 are pressurized to provide polishing pressures to polish the substrate. During the polishing operation, the perforated plate extends downward beyond the end of plunger 46, rendering the substrate sensor inactive.

Upon a completion of the polishing operation, a dechuck operation is performed to remove the substrate from a surface of the platen/pad surface of the polisher. The retaining ring pressure is maintained according to requirements of a given dechuck operation. The membrane 22 is vented. The perforated plate 40 is extended, until contacting the substrate. Extending of the perforated plate 40 also causes encapsulated region 28 to be pressurized due to the spring action of spring 42 acting upon plunger 46 and causing the captured resilient sealing ring 44 to seal off sensor venting ports 53. The pressurized region 28 is sensed by pressure sensor 32. Vacuum is pulled on membrane 22, wherein vacuum is drawn behind membrane 22 and within the openings of perforated plate 40, causing a suctioning effect between the membrane 22 and the substrate. In response to suctioning of the by membrane 22, the substrate acts upon plunger 46 in an upward fashion, causing plunger 46 to be displaced. Displacement of plunger 46 moves the captured resilient sealing ring 44 in a controlled manner to break the seal, thereby allowing region 28 to vent. The venting of region 28 causes a change in pressure of the encapsulated region. Accordingly, pressure sensor 32 senses the change in pressure, thus indicating the presence of the substrate.

According to one embodiment, a system for polishing a substrate includes a controller, a platen, and a carrier head. The carrier head is coupled to the controller. The carrier head is for carrying the substrate and holding the substrate against the platen during polishing. The carrier head includes a retaining ring for laterally supporting the substrate, a holding mechanism for applying positive pressure to the substrate during polishing and negative pressure when carrying the substrate, a gimbal plate coupled to the holding mechanism, and substrate detection means, coupled to the gimbal plate for detecting if the substrate is secured by the holding mechanism when the holding mechanism is applying negative pressure.

The substrate detection means includes a plunger passing through a hole in the gimbal plate. The plunger has a maximum travel distance in the hole, has a bottom surface that extends below the gimbal plate and is coupled to the substrate during detecting. When the holding mechanism is pressed to the gimbal plate, the plunger extends past the holding mechanism by an amount substantially equal to the maximum travel distance of the plunger.

In one embodiment, the plunger has a reduced thickness in an area above the gimbal plate, wherein the substrate detection means further comprises a compliant sealing ring around the area of the plunger having the reduced thickness. In addition, the substrate detection means has a spring applied to a top portion of the plunger above the gimbal plate, wherein the spring has a spring rate greater than 12 pounds per inch and less than 50 pounds per inch. Still further, the compliant sealing ring is captured by the plunger in the area of reduced thickness. The compliant sealing ring is also snugly against the plunger in the area of reduced thickness. The holding mechanism comprises a rigid perforated plate having a uniform thickness of less than 0.12 inch.

In another embodiment, the carrier head includes a retaining ring for laterally supporting the substrate, a holding mechanism for applying positive pressure to the substrate during polishing and negative pressure when carrying the substrate, a gimbal plate coupled to the holding mechanism, and substrate detection means, coupled to the gimbal plate for detecting if the substrate is secured by the holding mechanism when the holding mechanism is applying negative pressure. The substrate detection means includes a plunger passing through a hole in the gimbal plate. The plunger has a reduced thickness in an area above the gimbal plate. In addition, the substrate detection means also includes a compliant sealing ring around the area of the plunger having the reduced thickness.

Accordingly, the embodiments of the present disclosure provide improvements to wafer sensing reliability in a carrier head. Such improvements reduce the occurrence of wafer breakage, provide increased equipment availability, and decrease a cost of ownership of the carrier head and the polishing system.

In the foregoing specification, the disclosure has been described with reference to various embodiments. However, one of ordinary skill in the art appreciates that various modifications and changes can be made without departing from the scope of the present embodiments as set forth in the claims below. Accordingly, the specification and figures are to be regarded in an illustrative rather than a restrictive sense, and all such modifications are intended to be included within the scope of the present embodiments.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the term "comprises," "comprising," or any other variation thereof, are intended to cover a non-exclusive inclusion, such that a process, method, article, or apparatus that comprises a list of elements does not include only those elements by may include other elements not expressly listed or inherent to such process, method, article, or apparatus.

We claim:

1. A system for polishing a substrate, comprising:

a controller;

a platen; and a carrier head, coupled to the controller, for carrying the substrate and holding the substrate against the platen during polishing;

wherein the carrier head comprises:

a retaining ring for laterally supporting the substrate;

a holding mechanism for applying positive pressure to the substrate during polishing and negative pressure when carrying the substrate, the holding mechanism including a perforated plate and a membrane, the membrane being disposed between the perforated plate and the substrate, wherein responsive to a positive pressure applied to the perforated plate and the membrane, positive pressure is applied to the substrate, and wherein responsive to negative pressure applied to the perforated plate and the membrane, negative pressure is applied to the substrate;

a gimbal plate coupled to the holding mechanism; and substrate detection means, coupled to the gimbal plate for detecting if the substrate is secured by the holding mechanism when the holding mechanism is applying reactive pressure;

wherein the substrate detection means comprises:

a plunger passing through a hole in the gimbal plate wherein said plunger has a maximum travel distance in the hole, has a bottom surface that extends below the gimbal plate and is coupled to the substrate during detecting, and when the holding mechanism is pressed to the gimbal plate, the plunger extends past the perforated plate of the holding mechanism by an amount substantially equal to the maximum travel distance of the plunger, further wherein the plunger has a reduced thickness in an area above the gimbal plate, wherein the substrate detection means further comprises a compliant sealing ring around the area of the plunger having the reduced thickness.

2. The system of claim 1, wherein the substrate detection means has a spring applied to a top portion of the plunger above the gimbal plate, wherein the spring has a spring rate greater than 12 pounds per inch and less than 50 pounds per inch.

3. The system of claim 2, wherein the compliant sealing ring is captured by the plunger in the area of reduced thickness.

4. The system of claim 3, wherein compliant sealing ring is snugly against the plunger in the area of reduced thickness.

5. The system of claim 4, wherein the holding mechanism comprises a rigid perforated plate having a uniform thickness of less than 0.12 inch.

6. A system for polishing a substrate, comprising:

a controller;

a platen; and a carrier head, coupled to the controller, for carrying the substrate and holding the substrate against the platen during polishing;

wherein the carrier head comprises:

a retaining ring for laterally supporting the substrate;

a holding mechanism for applying positive pressure to the substrate during polishing and negative pressure when carrying the substrate, the holding mechanism including a perforated plate and a membrane, the membrane being disposed between the perforated plate and the substrate, wherein responsive to a positive pressure applied to the perforated plate and the membrane, positive pressure is applied to the substrate, and wherein responsive to a negative pressure applied to the perforated plate and the membrane, negative pressure is applied to the substrate;

a gimbal plate coupled to the holding mechanism; and substrate detection means, coupled to the gimbal plate for detecting if the substrate is secured by the holding mechanism when the holding mechanism is applying negative pressure;

wherein the substrate detection means comprises:

a plunger passing through a hole in the gimbal plate wherein said plunger has a reduced thickness in an area above the gimbal plate, wherein the substrate detection means further comprises a compliant sealing ring around the area of the plunger having the reduced thickness.

7. The system of claim 6, wherein the compliant sealing ring is captured by the plunger in the area of reduced thickness.

8. The system of claim 7, wherein compliant sealing ring is snugly against the plunger in the area of reduced thickness.

9. The system of claim 6, wherein the substrate detection means has a spring applied to a top portion of plunger above the gimbal plate, wherein the spring has a spring rate greater than 12 pounds per inch and less than 50 pounds per inch.

10. A system for polishing a substrate, comprising:

a controller;

a platen; and a carrier head, coupled to the controller, for carrying the substrate and holding the substrate against the platen during polishing;

wherein the carrier head comprises:

a retaining ring for laterally supporting the substrate;

a holding mechanism for applying positive pressure to the substrate during polishing and negative pressure when carrying the substrate, the holding mechanism including a perforated plate and a membrane, the membrane being disposed between the perforated plate and the substrate, wherein responsive to a positive pressure applied to the perforated plate and the membrane, positive pressure is applied to the substrate, and wherein responsive to a negative pressure applied to the perforated plate and the membrane, negative pressure is applied to the substrate;

a gimbal plate coupled to the holding mechanism; and substrate detection means, coupled to the gimbal plate for detecting if the substrate is secured by the holding mechanism when the holding mechanism is applying negative pressure;

wherein the substrate detection means comprises:

a plunger passing through a hole in the gimbal plate, wherein the plunger has a reduced thickness in an area above the gimbal plate;

a compliant sealing ring around the area of the plunger having the reduced thickness; and a spring applied to a top portion of plunger above the gimbal plate, wherein the spring has a spring rate greater than 12 pounds per inch and less than 50 pounds per inch.

11. The system of claim 10, wherein said plunger has a maximum travel distance in the hole, has a bottom surface that extends below the gimbal plate and is coupled to the substrate during detecting, and when the holding mechanism is pressed to the gimbal plate, the plunger extends past the gimbal plate by an amount substantially equal to the maximum travel distance of the plunger.

12. A system for polishing a substrate, comprising:

a controller;

pressure means, coupled to the controller, for providing pressure as selected by the controller;

a carrier head, coupled to the controller, comprising a holder, a top plate, and a detector for detecting the presence of the substrate in the carrier head;

wherein the detector comprises a plunger passing through a hole in the top plate wherein said plunger has a maximum travel distance in the hole, has a bottom surface that extends below the top plate and is coupled to the substrate during detecting, and when the holder is pressed to the top plate, the plunger extends past the holder by an amount substantially equal to the maximum travel distance of the plunger, further wherein the plunger has a reduced thickness in an area above the top plate, and wherein the detector further comprises a compliant sealing ring around the area of the plunger having the reduced thickness.

13. The system of claim 12, wherein the compliant sealing ring is captured by the plunger in the area of reduced thickness.

14. The system of claim 13, wherein compliant sealing ring is snugly against the plunger in the area of reduced thickness.

15. The system of claim 12, wherein the holder comprises a rigid perforated plate having a uniform thickness of less than 0.12 inch.

16. The system of claim 12, wherein the detector has a spring applied to a top portion of plunger above the top plate, wherein the spring has a spring rate greater than 12 pounds per inch and less than 50 pounds per inch.

17. A carrier head for use in a polishing system, comprising:

a holder;

a top plate; and a detector for detecting the presence of the substrate in the carrier head;

wherein the detector comprises a plunger pressing through a hole in the top plate wherein said plunger has a maximum travel distance in the hole, has a bottom surface that extends below the top plate and is coupled to the substrate during detecting, and when the holder is pressed to the top plate, the plunger extends past the holder by an amount substantially equal to the maximum travel distance of the plunger, further wherein the plunger has a reduced thickness in an area above the top plate, and wherein the detector further comprises a compliant sealing ring around the area of the plunger having the reduced thickness.

18. The carrier head of claim 17, wherein the compliant sealing ring is captured by the plunger in the area of reduced thickness.

19. The carrier head of claim 18, wherein the compliant sealing ring is snugly against the plunger in the area of reduced thickness.

20. The carrier head of claim 17, wherein the holder comprises a rigid perforated plate having a uniform thickness of less than 0.12 inch.

21. The carrier head of claim 17, wherein the detector has a spring applied to a top portion of the plunger above the top plate, wherein the spring has a spring rate greater than 12 pounds per inch and less than 50 pounds per inch.

* * * * *